United States Patent [19]

Van Anda

[11] Patent Number: 4,907,803

[45] Date of Patent: Mar. 13, 1990

[54] GAMEBOARD ACTIVATION/DEACTIVATION SYSTEM

[76] Inventor: William C. Van Anda, 2050 Allen St., Reno, Nev. 89509

[21] Appl. No.: 335,955

[22] Filed: Apr. 10, 1989

[51] Int. Cl.[4] ..... A63B 67/18

[52] U.S. Cl. ..... 273/30; 273/5 B

[58] Field of Search ..... 273/30, 3 R, 5 B, 3 A, 273/8; 248/188.2, 188.4, 188.5, 188.3, 180, 182

[56] References Cited

U.S. PATENT DOCUMENTS

| | | | |
|---|---|---|---|
| 3,341,198 | 9/1967 | Turpin, Sr. | 273/5 R |
| 3,480,247 | 11/1969 | Waner | 248/188.5 |
| 4,305,581 | 12/1981 | Neuharth | 273/5 R |
| 4,315,466 | 2/1982 | Boerigter | 248/188.5 |
| 4,522,295 | 6/1985 | Arndt | 273/30 |

*Primary Examiner*—T. Brown

*Attorney, Agent, or Firm*—Bruce & McCoy

[57] ABSTRACT

A gameboard activation/deactivation system which tilts the gameboard after a predeterined time to deactivate the board and raises it to level for play upon activation.

6 Claims, 1 Drawing Sheet

GAMEBOARD ACTIVATION/DEACTIVATION SYSTEM

BACKGROUND OF THE INVENTION

1. Field of the Invention

The present invention relates to gameboards and more particularly to ping pong tables which can be activated for play and deactivated to prevent unauthorized play.

2. Description of the Prior Art

Many electronic games are activated and deactivated for commercial play by timing devices or score counters. In those devices which have a set number of playing objects, such as balls, that are consumed as the game progresses, the game can be made to deactivate when the last object has been taken from play. In other games in which a set score terminates a game, the scoreboard can be deactivated when that score is reached. In still other types of games, particularly wholly electronic ones, the activation or deactivation is solely dependent upon the electronic circuit permitting the game to be played, and as soon as the allotted time for play runs out, the game deactivates.

In some types of more traditional or mechanical or older games, there has not been developed a way to deactivate the gameboard if the parties have the necessary additional implements for play. This has been a problem preventing commercial game operators from providing such games for play. One such game is ping pong. Generally, so long as the players have paddles and a ball, the game can be played. Therefore, in these types of games, there has not been an effective way in which to control play, if it is not automatically controlled by the game itself, such as by balls being captured in a pocket, until the present invention.

The present invention provides a way of activating and deactivating gameboards that require a level playing surface for commercial play. Such gameboards include ping pong, box hockey, shuffle board, and many others.

SUMMARY OF THE INVENTION

The present invention is a activation and deactivation system for a gameboard or playing surface which needs to be level for play. It comprises the gameboard playing surface which is secured to a mounting base. The mounting base is provided with a high side, and a lower side in relation to the higher side, and the gameboard is hinged to the high side. A means is provided which is disposed in the mounting base for raising and lowering the gameboard in response to activation and deactivation signals.

OBJECTS OF THE INVENTION

It is therefore an important object of the present invention to provide a means for activating and deactivating a gameboard or a playing surface.

It is another object of the present invention to provide a means for automatically activating and deactivating a ping pong table for commercial play.

It is a further object of the present invention to provide a means for raising and lowering a gameboard between a level and a tilted position in response to activation and deactivation signals.

Other objects and advantages of the present invention will become apparent when the gameboard activation and deactivation system of the present invention is considered in conjunction with the accompanying drawings.

DESCRIPTION OF THE PREFERRED EMBODIMENT

Figure 1:
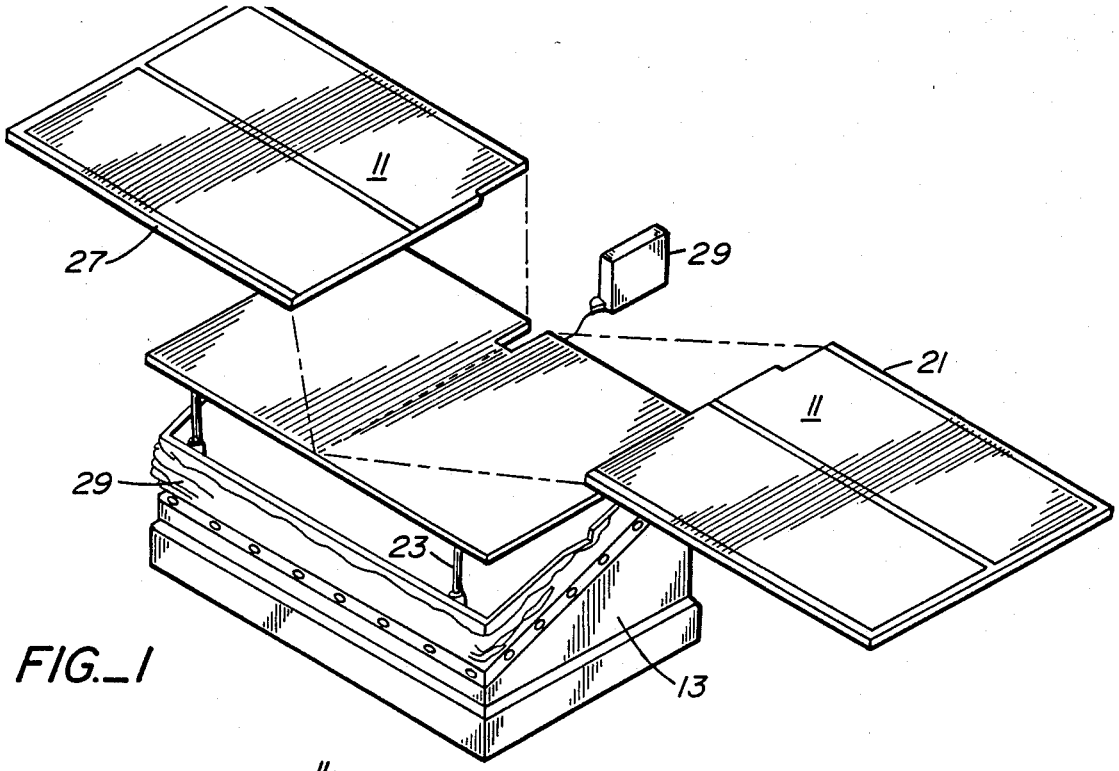
FIG. 1 is a perspective exploded view of a gameboard of the preferred embodiment of the present invention.
Figure 2:
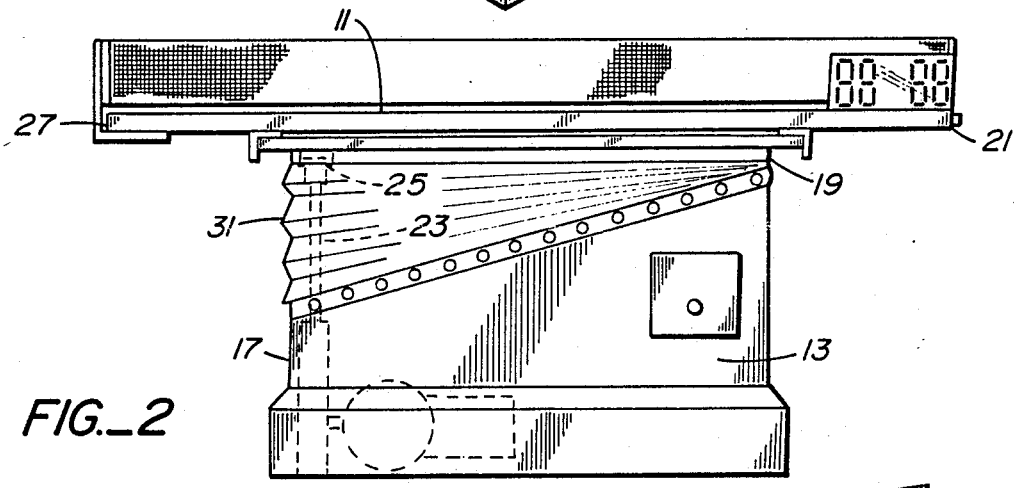
FIG. 2 is an end elevational view of the gameboard in playing position.
Figure 3:
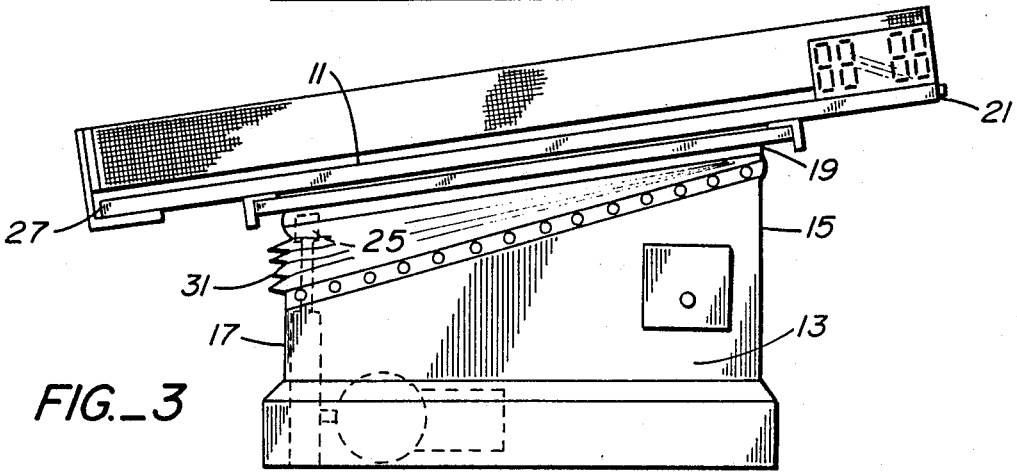
FIG. 3 is an end view in elevation of the gameboard of the present invention in deactivated condition.

Reference is made to the drawings for a description of the preferred embodiment of the present invention wherein like reference numbers represent like elements on corresponding views.

The present invention is a gameboard activation/-deactivation system. In the preferred embodiment, it relates specifically to a ping pong table but it can relate to any type of gameboard playing surface that needs to be level during play. The surface is deactivated to prevent unauthorized play by tilting it so that any attempt to play on the surface would be impossible.

The gameboard playing surface 11 is provided with a mounting base 13 having a high side 15 and a lower side 17 in relation to said high side. The gameboard playing surface is hinged 19 to the high side of the mounting base, and in the preferred embodiment, the table surface is secured proximate along one edge thereof with a hinge connection 19 of any suitable type to the high side 15 of the base. Since the width of the base is not equal to the full width of the ping pong table, the hinge connection is disposed inboard of the edge 21 of the table but parallel thereto. In a table or playing surface having a higher L/W ratio, the hinge can be mounted closer to the playing surface edge.

A means is disposed in the base for raising and lowering the gameboard in response to activation and deactivation signals. This means is comprised of several elements. It includes at least one extendable cylinder 23 which engages the gameboard at a position opposite 25 to where the gameboard is hinged to the base. The cylinder(s) could be either a compressed gas cylinder (one in which the normal condition is extended unless it is collapsed by force to the retracted position) or it could be a compressed air or hydraulicly actuated cylinder which is cycled by the introduction of either compressed air or a fluid under pressure to extend the cylinder and collapsed by the release or outletting of either the compressed air or the fluid.

In the preferred embodiment of the invention, a pair of compressed air cylinders 25 are provided disposed in spaced relation in the base along the length of the table to provide a more stable activation and support means for the game playing surface 11. The pair of cylinders are secured proximate the opposite edge 27 of the table surface from the hinge connection with the base. The cylinders have a predetermined extension length whereby when they extend to the selected length, the game playing surface will be disposed level on the base.

A means is provided for introducing compressed air into the cylinders upon receipt of an activation signal and for releasing compressed air from the cylinders upon receipt of a deactivation signal. In the preferred embodiment, an electric motor-driven air compressor (not shown) disposed inside the base is provided for generating the compressed air to extend the cylinders 25. An electric solenoid actuated on-off switch for the compressor is activated to the "on" condition by an activation signal. In the preferred embodiment of the invention, the switch automatically switches to the "off" condition when a predetermined air pressure is reached in the cylinders after they have been fully extended. When the selected pressure is sensed by a sensor, it sends a signal to the solenoid which reverses the on-off switch to the "off" condition.

A means is provided for releasing the compressed air from the cylinders upon receipt of a deactivation signal, and this is simply a solenoid controlled air release valve which is activated by an electronic deactivation signal to open the valve and allow the compressed air to escape from the compressed air cylinders. These elements are all commercially available items and are therefore not illustrated in the drawings.

The means for raising and lowering the gameboard also includes a coin receiver, timer, and signal generator (also commercially available items) which operate in the following manner. As a coin is inserted into the coin receiver, an electronic signal is generated to activate the gameboard, and as a preselected time limit elapses without resetting of the timer by insertion of another coin into the coin receiver, a signal is generated to deactivate the gameboard.

The gameboard can also be provided with an electronic scoreboard 29 which is activated by buttons secured to the edges of the table near the ends. The scoreboard could be utilized to generate the deactivation signal upon reaching a preselected score.

An alternative embodiment of the invention could include compressed gas cylinders which have an electric driven jack screw whereby as the activation signal occurs the compressed gas cylinders would be allowed to expand to the preselected length raising the gameboard to the level position. Upon receipt of a deactivation signal, a jack screw could be used to pull the gameboard down to the deactivated condition against the extension pressure of the gas cylinders. As a further alternative, jack screws alone could be used for raising and lowering the gameboard.

It is also to be understood that the coin receiver need not literally receive legal tender but could receive substituted slugs or could be electronically activated by a control signal to indicate that authorized play can take place for predetermined lengths of time. Other means for controlling the activation/ deactivation signals are also within the scope of the invention but not relevant to the operation thereof.

A protection means is provided to prevent foreign objects and players or small children's anatomy from being trapped between the playing surface and the lower sides of the mounting base when the gameboard is deactivated. In its simplest form it is a collapsible skirt 31 secured around the lower side of the base and between the base and the playing surface.

Thus, it will be seen from the description of the preferred embodiment that all of the objects and advantages of the invention are achieved. While the preferred embodiment of the invention has been described in considerable detail herein, the invention is not to be limited to such details as have been set forth except as may been necessitated by the appended claims.

I claim:

1. A gameboard activation/deactivation system comprising a gameboard surface that needs to be level during play, a mounting base for said gameboard provided with a high side and a lower side in relation to said high side, said gameboard being hinged to the high side of said mounting base, and means disposed in said base for raising said gameboard to level and lowering said gameboard to a tilted position in response to activation and deactivation signals, respectively.

2. The gameboard of claim 1 wherein said means for raising and lowering said gameboard includes at least one extension/retraction member which engages said gameboard at a position opposite to where said gameboard is hinged to said base, said extension/retraction member having a preselected extension length to which it extends upon receipt of an actuation signal and a collapsed position to which it retracts upon receipt of a deactivation signal.

3. The gameboard of claim 2 wherein said means for raising and lowering said gameboard includes a pair of spaced apart compressed air actuated cylinders having predetermined extension lengths.

4. The gameboard of claim 3 wherein means are provided for introducing compressed air into said cylinders upon receipt of an activation signal and for releasing compressed air from said cylinders upon receipt of a deactivation signal.

5. The gameboard of claim 1 wherein a coin receiver, timer, and signal generator are provided whereby as a coin is inserted into said receiver, a signal is generated to activate said gameboard, and as a preselected time limit elapses without resetting of the timer by insertion of another coin in the coin receiver, a signal is generated to deactivate said gameboard.

6. A ping pong table activation and deactivation system comprising a table surface secured to a mounting base having a high side and a lower side in relation to said high side, said table surface being secured proximate along one edge thereof with a hinged connection to the high side of said base, a pair of compressed air activated air cylinders disposed in said base and having a predetermined extension length, said cylinders secured proximate the opposite edge of said table surface from the hinged connection thereof to said base in spaced relation to each other along said opposite edge, a compressed air generation means for introducing compressed air into said cylinders upon receipt of an activation signal, means for releasing compressed air from said cylinders upon receipt of a deactivation signal, and a coin receiver, timer, and signal generator whereby as a coin is inserted into said receiver, an activation signal is generated to activate said gameboard by causing the introduction of compressed air into said cylinders from said compressed air generation means until they are fully extended to the predetermined length and after a preselected time limit elapses without resetting of the timer by insertion of another coin in the coin receiver, a signal is generated to deactivate said gameboard by releasing compressed air from said air cylinders.

* * * * *